US008132272B1

(12) United States Patent
Esposito

(10) Patent No.: US 8,132,272 B1
(45) Date of Patent: Mar. 13, 2012

(54) TOILET SEAT LIFTING SYSTEM

(76) Inventor: Anthony Esposito, Palm Harbor, FL (US)

( * ) Notice: Subject to any disclaimer, the term of this patent is extended or adjusted under 35 U.S.C. 154(b) by 267 days.

(21) Appl. No.: 12/387,111

(22) Filed: Apr. 28, 2009

(51) Int. Cl.
*A47K 13/10* (2006.01)

(52) U.S. Cl. ..... 4/246.1

(58) Field of Classification Search ..... 4/246.1, 4/246.3; 403/329, 397, DIG. 14; 411/508, 411/913; 24/614, 615
See application file for complete search history.

(56) References Cited

U.S. PATENT DOCUMENTS

| | | | | |
|---|---|---|---|---|
| 2,431,118 | A * | 11/1947 | Heigle | 279/89 |
| 3,935,601 | A | 2/1976 | Hermann | |
| 4,129,907 | A * | 12/1978 | Vaughan et al. | 4/246.1 |
| 4,878,792 | A * | 11/1989 | Frano | 411/339 |
| 5,220,693 | A * | 6/1993 | Paglia | 4/246.1 |
| 5,279,335 | A * | 1/1994 | Bassi | 139/59 |
| 5,375,267 | A | 12/1994 | Davis | |
| 5,590,425 | A * | 1/1997 | Janik, Jr. | 4/246.1 |
| 5,727,258 | A | 3/1998 | Derouin | |
| 6,303,183 | B1 * | 10/2001 | Wilczynski et al. | 427/193 |
| 6,634,032 | B1 * | 10/2003 | Janik | 4/246.1 |
| 6,691,330 | B2 * | 2/2004 | Baker | 4/246.1 |
| 6,704,967 | B2 * | 3/2004 | Gianelli et al. | 16/422 |
| 6,983,492 | B1 * | 1/2006 | Larson | 4/246.1 |
| 2004/0151539 | A1 * | 8/2004 | Sikora et al. | 403/329 |
| 2007/0089280 | A1 * | 4/2007 | Pontaoe | 24/614 |

* cited by examiner

*Primary Examiner* — Brian Glessner
*Assistant Examiner* — Brian D Mattei

(57) ABSTRACT

A toilet seat in a generally ring like configuration has an upper surface, a lower surface, and a peripheral edge. A slot has an input opening. The input opening is located adjacent to a peripheral edge of the toilet seat. A lift assembly has an interior section, an exterior section, and an intermediate section. The interior section is positionable into the slot. The exterior section is in a cylindrical configuration. The exterior section extends radially exterior of the toilet seat. The intermediate section is positionable adjacent to the peripheral edge of the toilet seat.

2 Claims, 6 Drawing Sheets

FIG 1
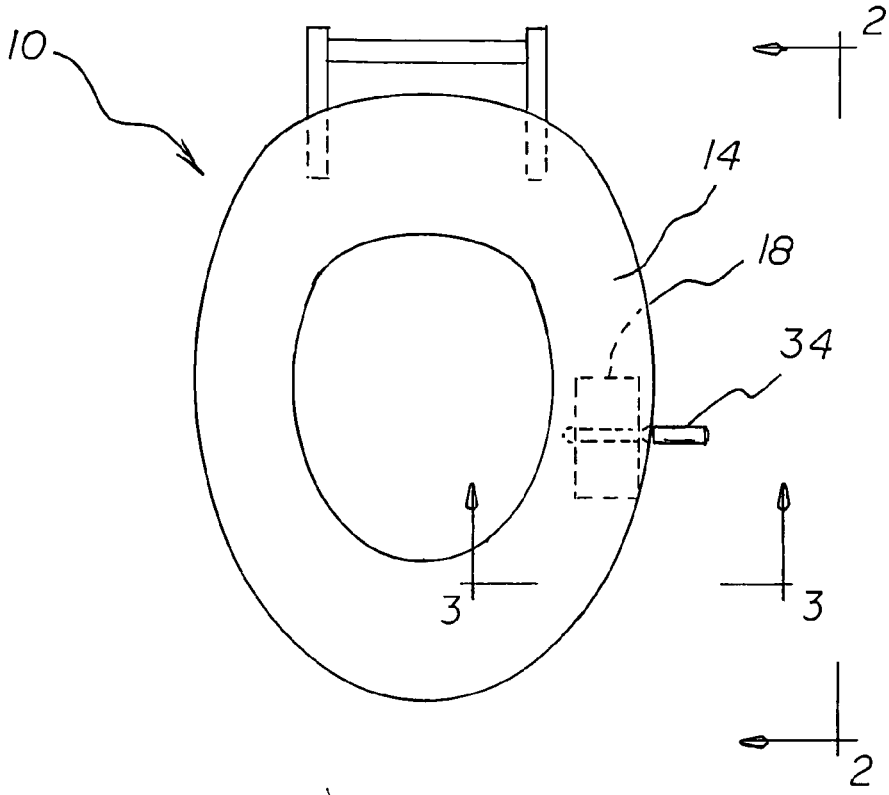
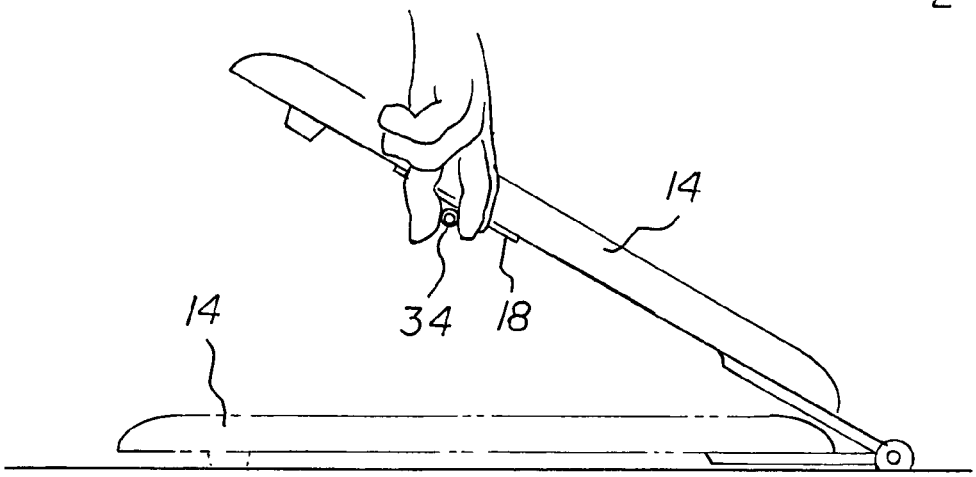
FIG 2

FIG 3
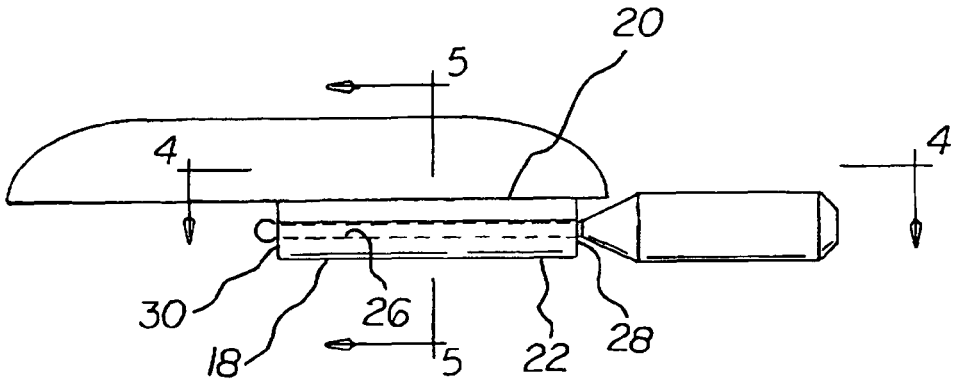
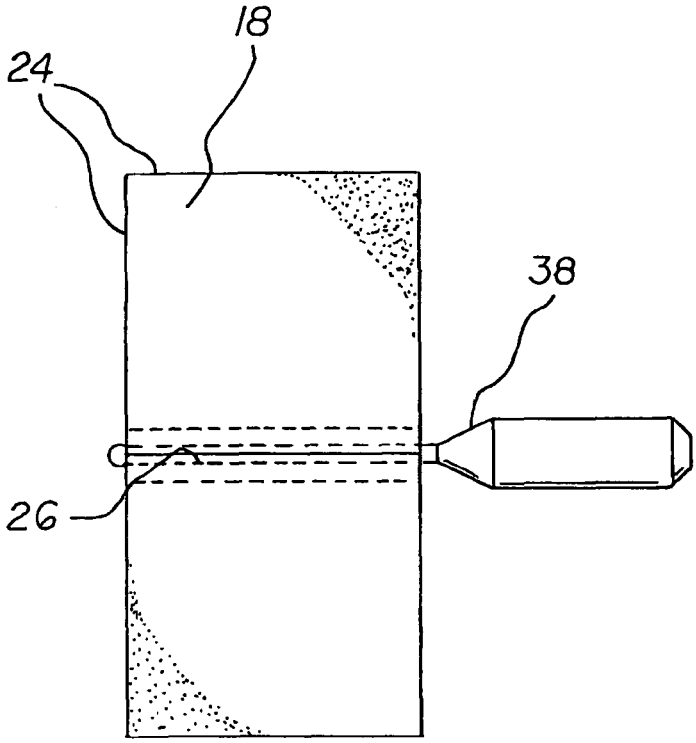
FIG 4

FIG 5
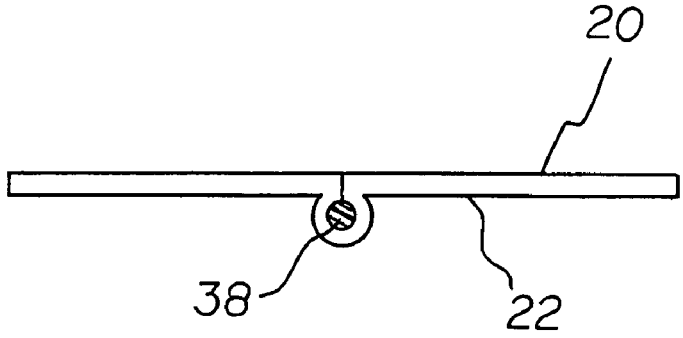
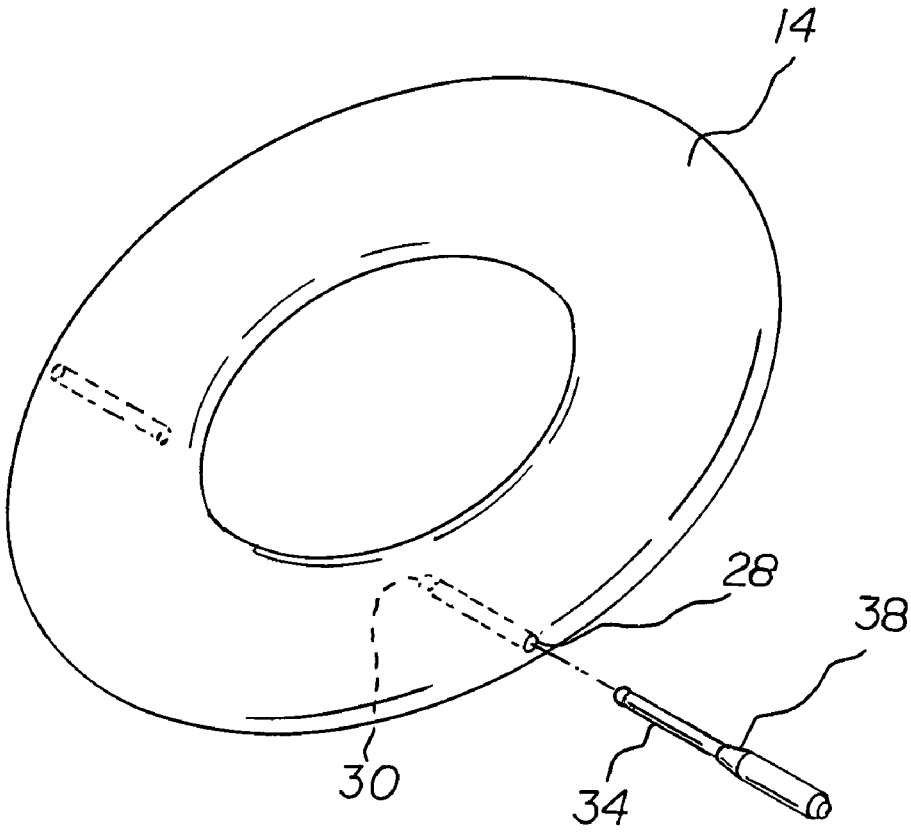
FIG 6

FIG 7
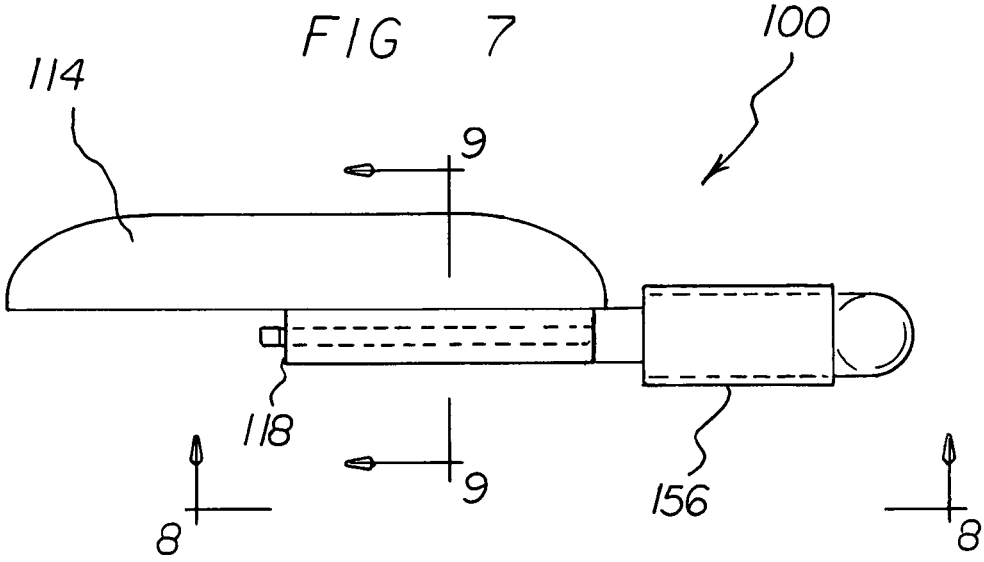
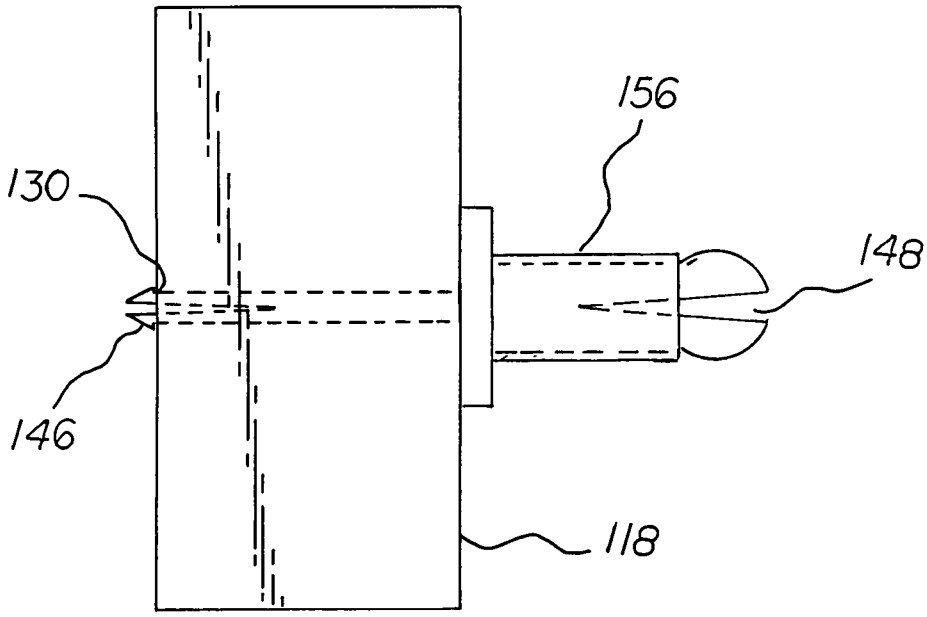
FIG 8

FIG 9
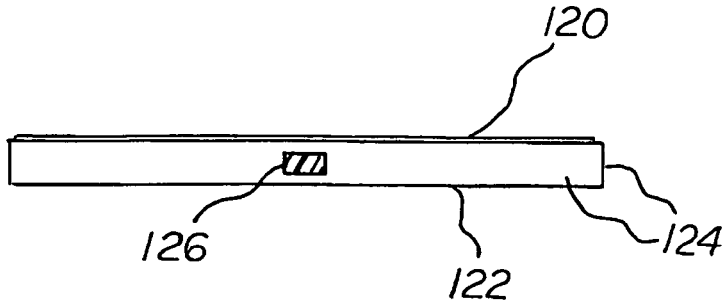
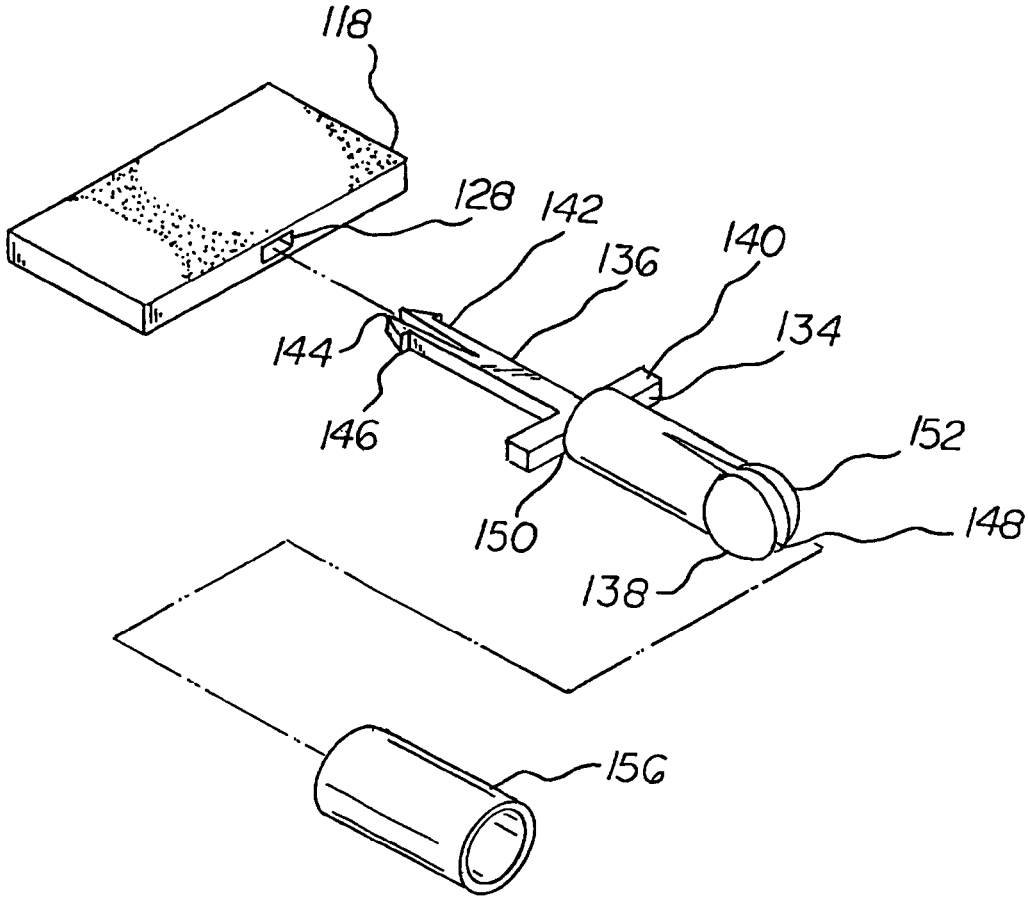
FIG 10

TOILET SEAT LIFTING SYSTEM

BACKGROUND OF THE INVENTION

1. Field of the Invention

The present invention relates to a toilet seat lifting system and more particularly pertains to raising and lowering a toilet seat with a removably couplable handle, the raising and lowering of the toilet seat being done in a safe, sanitary, convenient and economical manner.

2. Description of the Prior Art

The use of toilet seat systems of known designs and configurations is known in the prior art. More specifically, toilet seat systems of known designs and configurations previously devised and utilized for the purpose of raising and lowering toilet seats through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,935,601 issued Feb. 3, 1976 to Hermann relates to a Sanitary Toilet Seat Ring Lift. U.S. Pat. No. 5,375,267 issued Dec. 27, 1994 relates to a Toilet Seat Lifting Device. Lastly, U.S. Pat. No. 5,727,258 issued Mar. 17, 1998 to Derouin relates to a Toilet Seat Lifting Handle Having Scented Elements.

While these devices fulfill their respective, particular objectives and requirements, the aforementioned patents do not describe a toilet seat lifting system that allows for raising and lowering a toilet seat with a removably couplable handle, the raising and lowering of the toilet seat being done in a safe, sanitary, convenient and economical manner.

In this respect, the toilet seat lifting system according to the present invention substantially departs from the conventional concepts and designs of the prior art, and in doing so provides an apparatus primarily developed for the purpose of raising and lowering a toilet seat with a removably couplable handle, the raising and lowering of the toilet seat being done in a safe, sanitary, convenient and economical manner.

Therefore, it can be appreciated that there exists a continuing need for a new and improved toilet seat lifting system which can be used for raising and lowering a toilet seat with a removably couplable handle, the raising and lowering of the toilet seat being done in a safe, sanitary, convenient and economical manner. In this regard, the present invention substantially fulfills this need.

SUMMARY OF THE INVENTION

In view of the foregoing disadvantages inherent in the known types of toilet seat systems of known designs and configurations now present in the prior art, the present invention provides an improved toilet seat lifting system. As such, the general purpose of the present invention, which will be described subsequently in greater detail, is to provide a new and improved toilet seat lifting system and method which has all the advantages of the prior art and none of the disadvantages.

To attain this, the present invention essentially comprises a toilet seat lifting system. Note FIGS. 11 and 12 for the primary embodiment of the invention. First provided is a toilet seat. The toilet seat is in a generally ring like configuration. The toilet seat has a front and a rear and a left side and a right side. The toilet seat has a central opening. The central opening is bounded by an interior edge and an exterior edge. The toilet seat has an upper surface and a lower surface. The upper surface is adapted to receive a user.

A reception block is provided. The reception block has an upper surface. The reception block has a lower surface. The reception block also has a peripheral edge. The upper surface of the reception block is adhesively secured to the lower surface of the toilet seat at one side of the toilet seat. A slot is provided. The slot extends through the reception block. The slot has an input opening. The slot has an output opening. The slot has a length and a width. The input opening is located through the peripheral edge beneath the exterior edge of the toilet seat. The output opening is located through the peripheral edge of the reception block adjacent to the interior edge of the toilet seat. The lower surfaces have recesses. The recesses are provided on opposite sides of the slot.

Provided next is a lift assembly. The lift assembly has an interior section. The lift assembly has an exterior section. The lift assembly also has an intermediate section. The interior section is positionable through the slot. The interior section has two laterally spaced parallel fingers. Each finger terminates in a V-shaped prong. The V-shaped prong extends exteriorly of the slot. The prongs are adapted to be pushed together. In this manner removal of the lift assembly from the reception block is allowed. The exterior section of the lift assembly is in a cylindrical configuration. The exterior section has an axial slot. The exterior section has an interior end. The interior end has a radial enlargement. The radial enlargement is in a cylindrical configuration. The exterior section has an exterior end. The exterior end has a radial enlargement. The radial enlargement is in a cylindrical configuration. The intermediate section has lateral extensions. The lateral extensions are positionable against the peripheral edge of the reception block. In this manner the insertion of the lift assembly into the reception block is limited.

Provided last is a handle. The handle is provided in a tubular configuration. The handle is removably positioned on the exterior section of the lift assembly. The handle has a length. The length of the handle is essentially equal to the length of the exterior section between the radial enlargements. The handle has a diameter. The diameter of the handle is greater than the diameter of the exterior section but less than the diameter of the enlargements. In this manner the handle may be grasped while lifting and lowering the toilet seat. Also in this manner the radially enlargement at the exterior end of the exterior section may be squeezed. Further in this manner the handle is allowed to be removed from the exterior section for cleaning purposes. The lift assembly and handle are fabricated of copper coated zinc. In this manner cleaning and cleanliness of the system is facilitated.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved toilet seat lifting system which has all of the advantages of the prior art toilet seat systems of known designs and configurations and none of the disadvantages.

It is another object of the present invention to provide a new and improved toilet seat lifting system which may be easily and efficiently manufactured and marketed.

It is further object of the present invention to provide a new and improved toilet seat lifting system which is of durable and reliable constructions.

An even further object of the present invention is to provide a new and improved toilet seat lifting system which is susceptible of a low cost of manufacture with regard to both materials and labor, and which accordingly is then susceptible of low prices of sale to the consuming public, thereby making such toilet seat lifting system economically available to the buying public.

Even still another object of the present invention is to provide a toilet seat lifting system for raising and lowering a toilet seat with a removably couplable handle, the raising and lowering of the toilet seat being done in a safe, sanitary, convenient and economical manner.

Lastly, it is an object of the present invention to provide a new and improved toilet seat lifting system. A toilet seat in a generally ring like configuration has an upper surface, a lower surface, and a peripheral edge. A slot has an input opening. The input opening is located adjacent to a peripheral edge of the toilet seat. A lift assembly has an interior section, an exterior section, and an intermediate section. The interior section is positionable into the slot. The exterior section is in a cylindrical configuration. The exterior section extends radially exterior of the toilet seat. The intermediate section is positionable adjacent to the peripheral edge of the toilet seat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a toilet seat lifting system constructed in accordance with the principles of the present invention.

FIG. 2 is a side elevational view of the system taken along line 2-2 of FIG. 1.

FIG. 3 is a cross sectional view taken along line 3-3 of FIG. 2.

FIGS. 4 and 5 are cross sectional views taken along lines 4-4 and 5-5 of FIG. 3 respectively.

FIG. 6 is an exploded perspective illustration of the system.

FIG. 7 is a side elevational view of an alternate embodiment of the invention.

FIG. 8 is a bottom view of the system taken along line 8-8 of FIG. 2.

FIG. 9 is a cross sectional views taken along lines 9-9 of FIG. 7.

FIG. 10 is an exploded perspective illustration of the system of FIGS. 7 through 9.

The same reference numerals refer to the same parts throughout the various Figures.

DESCRIPTION OF THE PREFERRED EMBODIMENT

Figure 11:
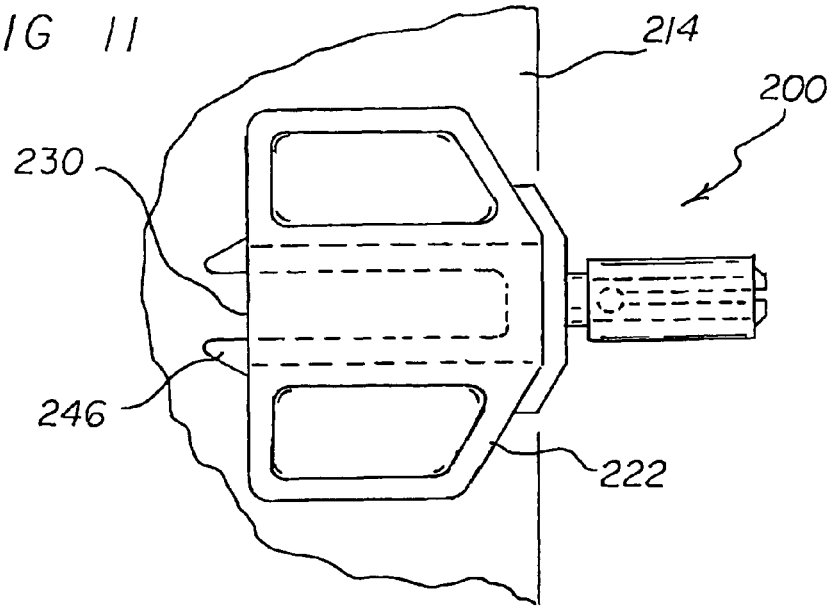
FIG. 11 is a bottom view of a final alternate embodiment of the invention.

With reference now to the drawings, and in particular to FIG. 1 thereof, the preferred embodiment of the new and improved toilet seat lifting system embodying the principles and concepts of the present invention and generally designated by the reference numeral 10 will be described.

The present invention, the toilet seat lifting system 10 is comprised of a plurality of components. Such components in their broadest context include a toilet seat, a slot, and a lift assembly. Such components are individually configured and correlated with respect to each other so as to attain the desired objective.

Figure 12:
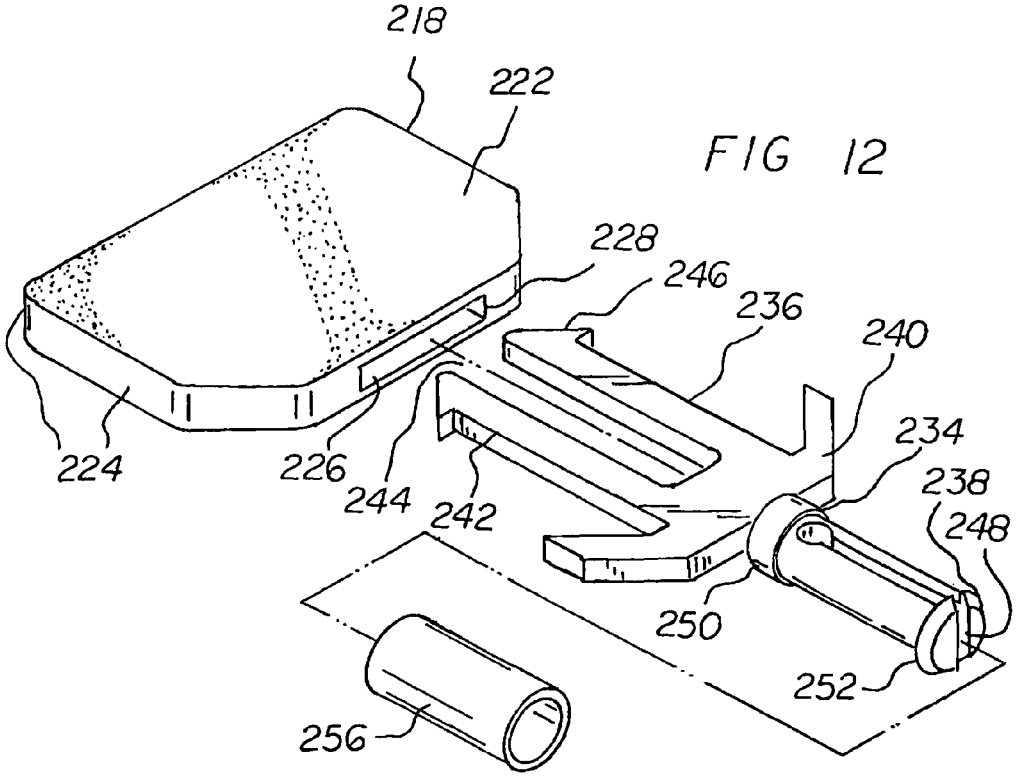
FIG. 12 is an exploded perspective illustration of the system of FIG. 11.

Note FIGS. 11 and 12 for the primary embodiment of the invention. First provided is a toilet seat 204. The toilet seat is in a generally ring like configuration. The toilet seat has a front and a rear and a left side and a right side. The toilet seat has a central opening. The central opening is bounded by an interior edge and an exterior edge. The toilet seat has an upper surface and a lower surface. The upper surface is adapted to receive a user.

A reception block 208 is provided. The reception block has an upper surface 210. The reception block has a lower surface 212. The reception block also has a peripheral edge 214. The upper surface of the reception block is adhesively secured to the lower surface of the toilet seat at one side of the toilet seat. A slot 216 is provided. The slot extends through the reception block. The slot has an input opening 218. The slot has an output opening 220. The slot has a length and a width. The input opening is located through the peripheral edge beneath the exterior edge of the toilet seat. The output opening is located through the peripheral edge of the reception block adjacent to the interior edge of the toilet seat. The lower surfaces have recesses 222. The recesses are provided on opposite sides of the slot.

Provided next is a lift assembly 226. The lift assembly has an interior section 228. The lift assembly has an exterior section 230. The lift assembly also has an intermediate section 232. The interior section is positionable through the slot. The interior section has two laterally spaced parallel fingers 234. Each finger terminates in a V-shaped prong 236. The V-shaped prong extends exteriorly of the slot. The prongs are adapted to be pushed together. In this manner removal of the lift assembly from the reception block is allowed. The exterior section of the lift assembly is in a cylindrical configuration. The exterior section has an axial slot 238. The exterior section has an interior end 240. The interior end has a radial enlargement. The radial enlargement is in a cylindrical configuration. The exterior section has an exterior end 242. The exterior end has a radial enlargement. The radial enlargement is in a cylindrical configuration. The intermediate section has lateral extensions 244. The lateral extensions are positionable against the peripheral edge of the reception block. In this manner the insertion of the lift assembly into the reception block is limited.

Provided last is a handle 248. The handle is provided in a tubular configuration. The handle is removably positioned on the exterior section of the lift assembly. The handle has a length. The length of the handle is essentially equal to the length of the exterior section between the radial enlargements. The handle has a diameter. The diameter of the handle is greater than the diameter of the exterior section but less than the diameter of the enlargements. In this manner the handle may be grasped while lifting and lowering the toilet seat. Also in this manner the radially enlargement at the exterior end of the exterior section may be squeezed. Further in this manner the handle is allowed to be removed from the exterior section for cleaning purposes. The lift assembly and handle are fabricated of copper coated zinc. In this manner cleaning and cleanliness of the system is facilitated.

An alternate embodiment 10 of the present invention is provided. Note FIGS. 1 through 6. A toilet seat 14 is provided. The toilet seat has a front and a rear and a left side and a right side. The toilet seat has a central opening. The central opening is bounded by an interior edge and an exterior edge.

A reception block 18 is provided. The reception block has an upper surface 20. The reception block has a lower surface 22. The reception block has a peripheral edge 24. The upper surface of the reception block is adhesively secured to the lower surface of the toilet seat at one side of the toilet seat. A slot 26 is provided. The slot extends through the reception block. The slot has an input opening 28. The slot has an output opening 30. The slot has a length and a width. The input opening is located through the peripheral edge of the reception block beneath the exterior edge of the toilet seat. The output opening is located through the peripheral edge of the reception block adjacent to the interior edge of the toilet seat.

A lift assembly 34 is provided. The lift assembly is of a one piece construction. The lift assembly has an interior section. The interior section has an enlargement. In this manner inadvertent removal from the slot is precluded. The lift assembly has an intermediate section 38. The intermediate section is in a cone shaped configuration. In this manner the insertion of the lift assembly into the reception block is limited. The lift assembly is fabricated of copper coated zinc. In this manner cleaning and cleanliness of the system is facilitated.

Another alternate embodiment 100 of the present invention is provided. Note FIGS. 7 through 10. A toilet seat 114 is provided. The toilet seat has a front and a rear and a left side and a right side. The toilet seat has a central opening. The central opening is bounded by an interior edge and an exterior edge.

A reception block 118 is provided. The reception block has an upper surface 120. The reception block has a lower surface 122. The reception block has a peripheral edge 124. The upper surface of the reception block is adhesively secured to the lower surface of the toilet seat at one side of the toilet seat. A slot 126 is provided. The slot extends through the reception block. The slot has an input opening 128. The slot has an output opening 130. The slot has a length and a width. The input opening is located through the peripheral edge of the reception block beneath the exterior edge of the toilet seat. The output opening is located through the peripheral edge of the reception block adjacent to the interior edge of the toilet seat.

A lift assembly 134 is provided. The lift assembly has an interior section 136. The lift assembly has an exterior section 138. The lift assembly has an intermediate section 140. The interior section is positionable through the slot. The intermediate section has two fingers 142. The finger has an inwardly extending opening 144. The opening is provided remote from the exterior section. Each finger terminates in a V-shaped prong 146. The V-shaped prong extends exteriorly of the slot. The prongs are adapted to be pushed together. In this manner removal of the lift assembly from the reception block is allowed. The exterior section of the lift assembly is in a cylindrical configuration. The exterior section has an outwardly extending opening 148. The exterior section has an interior end. The interior end has a radial enlargement 150. The exterior section has an exterior end. The exterior end has a radial enlargement 152. The radial enlargement is in a spherical configuration. The radial enlargement at the interior end of the exterior section is positionable against the peripheral edge of the reception block. In this manner the insertion of the lift assembly into the reception block is limited.

A handle 156 is provided. The handle is in a tubular configuration. The handle is removably positioned on the exterior section of the lift assembly. The handle has a length. The length of the handle is essentially equal to the length of the exterior section between the radial enlargements. The handle has a diameter. The diameter of the handle is greater than the diameter of the exterior section but less than the diameter of the enlargements. In this manner the handle may be grasped while lifting and lowering the toilet seat. Also in this manner the radially enlargement at the exterior end of the exterior section may be squeezed. Further in this manner the handle is allowed to be removed from the exterior section for cleaning purposes. The lift assembly and handle are fabricated of copper coated zinc. In this manner cleaning and cleanliness of the system is faciliated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toilet seat lifting system for raising and lowering a toilet seat with a removably couplable handle, the system comprising, in combination:

a toilet seat having a front and a rear and a left side and a right side, the toilet seat having a central opening bounded by an interior edge and an exterior edge;

a reception block having an upper surface and a lower surface and a peripheral edge, the upper surface of the reception block being adhesively secured to the lower surface of the toilet seat at one side of the toilet seat, the slot extending through the reception block, the input opening having an output opening defining a length and a width, the input opening being located through the peripheral edge of the reception block beneath the exterior edge of the toilet seat, the output opening being located through the peripheral edge of the reception block adjacent to the interior edge of the toilet seat;

a one-piece lift assembly having an interior section and an exterior section and an intermediate section, the interior section and exterior section and intermediate section of the lift assembly being positionable with the interior section extending through the slot, the interior section being formed of two fingers with an inwardly extending opening remote from the exterior section, each finger terminating in a V-shaped prong extending exteriorly of the slot, the prongs adapted to be pushed together to allow removal of the lift assembly from the reception block, the exterior section of the lift assembly being in a cylindrical configuration with an outwardly extending opening, the exterior section having an interior end with a radial enlargement and an exterior end with a radial enlargement in a spherical configuration, the radial enlargement at the interior end of the exterior section being positionable against the peripheral edge of the reception block to limit the insertion of the lift assembly into the reception block; and a handle in a tubular configuration removably positioned on the exterior section of the lift assembly, the handle having a length essentially equal to the length of the exterior section between the radial enlargements, the handle having a diameter greater than the diameter of the exterior section but less than the diameter of the enlargements whereby the handle is adapted to be grasped while lifting and lowering the toilet seat and whereby the radially enlargement at the exterior end of the exterior section adapted to be squeezed to allow the handle to be removed from the exterior section for cleaning purposes, the lift assembly and handle being fabricated of copper coated zinc to facilitate cleaning and cleanliness of the system.

2. A toilet seat lifting system for raising and lowering a toilet seat with a removably couplable handle, the system comprising, in combination:

a toilet seat in a generally toroidal configuration with a front and a rear and a left side and a right side, the toilet seat having a central opening bounded by an interior edge and an exterior edge, the toilet seat having an upper surface and a lower surface, the upper surface adapted to receive a user;

a reception block having an upper surface and a lower surface and a peripheral edge, the upper surface of the reception block being adhesively secured to the lower surface of the toilet seat at one side of the toilet seat, a slot extending through the reception block, the slot having an input opening and an output opening, the slot having a length and a width, the input opening being located through the peripheral edge beneath the exterior edge of the toilet seat, the output opening being located through the peripheral edge of the reception block adjacent to the interior edge of the toilet seat, the lower surfaces being formed with recesses on opposite sides of the slot;

a lift assembly having an interior section and an exterior section and an intermediate section, the interior section positionable through the slot and formed of two laterally spaced parallel fingers, each finger terminating in a V-shaped prong extending exteriorly of the slot, the prongs adapted to be pushed together to allow removal of the lift assembly from the reception block, the exterior section of the lift assembly being in a cylindrical configuration with an axial slot, the exterior section having an interior end with a radial enlargement in a cylindrical configuration and an exterior end with a radial enlargement in a cylindrical configuration, the intermediate section having lateral extensions positionable against the peripheral edge of the reception block to limit the insertion of the lift assembly into the reception block; and a handle in a tubular configuration removably positioned on the exterior section of the lift assembly, the handle having a length essentially equal to the length of the exterior section between the radial enlargements, the handle having a diameter greater than the diameter of the exterior section but less than the diameter of the enlargements whereby the handle is adapted to be grasped while lifting and lowering the toilet seat and whereby the radially enlargement at the exterior end of the exterior section is adapted to be squeezed to allow the handle to be removed from the exterior section for cleaning purposes, the lift assembly and handle being fabricated of copper coated zinc to facilitate cleaning and cleanliness of the system.

* * * * *